United States Patent [19]

Bethge et al.

[11] Patent Number: 4,745,729

[45] Date of Patent: May 24, 1988

[54] SCREW HEAD ON CONTAINER-CLOSING MACHINE

[75] Inventors: Gerhard Bethge, Cologne; Albert Schmitz, Kurten-Eichhof, both of Fed. Rep. of Germany

[73] Assignee: Robert Bosch GmbH, Stuttgart, Fed. Rep. of Germany

[21] Appl. No.: 106,219

[22] Filed: Oct. 9, 1987

[30] Foreign Application Priority Data

Nov. 26, 1986 [DE] Fed. Rep. of Germany ..... 3640417

[51] Int. Cl.[4] ..... B65B 7/28; B67B 3/20

[52] U.S. Cl. ..... 53/331.5; 53/353

[58] Field of Search ..... 53/317, 331.5, 351, 53/352, 353, 361, 334

[56] References Cited

U.S. PATENT DOCUMENTS

| | | | |
|---|---|---|---|
| 1,585,820 | 5/1926 | Baum | 53/352 X |
| 2,339,119 | 1/1944 | Thomas | 53/352 X |
| 3,075,331 | 1/1963 | Stanley | 53/353 |
| 3,491,516 | 1/1970 | Bergeron | 53/331.5 X |
| 4,098,053 | 7/1978 | Shank | 53/352 X |

*Primary Examiner*—Horace M. Culver

*Attorney, Agent, or Firm*—Edwin E. Greigg

[57] ABSTRACT

A screw head on a container-closing machine has jaws that are pivotable on a holder to grasp a closure cap and hold the cap tightly so that the cap can be screwed onto a container. For pivoting the jaws, the jaws are connected to levers, which rest on an actuating cone that is displaceable coaxially in the holder. The actuating cone is integrally connected to a piston of a cylinder-piston unit, which is likewise disposed coaxially in the holder and the piston is operable by a controlled fuel supply.

8 Claims, 1 Drawing Sheet

SCREW HEAD ON CONTAINER-CLOSING MACHINE

BACKGROUND OF THE INVENTION

The invention is based on a screw head on a container-closing machine. In a screw head of this kind, known for example from U.S. Pat. No. 1,797,679, the actuating cone is secured to a rod that passes through the tubular spindle. To grasp a closure cap and hold it firmly, the rod with the actuating cone is displaced downward by a roller and a cam, whereupon the levers joined to the jaws are pivoted in the direction of closure. The known screw head, together with the spindle and the actuating rod, has a relatively great mass; hence, because of its inertia, it cannot be screwed on precisely, with a uniform tightening torque.

German Pat. No. 28 46 846 also discloses a screw head, in which the retaining jaws are radially displaceably arranged and are actuated by an annular diaphragm that can be acted upon by pressure medium. Although this screw head is compact in structure and is also simple to control, it still has great inertial moment because of its relatively large diameter, so that precision tightening of screw closures is not assured.

OBJECT AND SUMMARY OF THE INVENTION

The screw head according to the invention has the advantage over the prior art that its mass and hence its inertial moment are low, so that a turning closure means can be grasped and tightened under precise control. With it, forceful grasping of the closures is also possible so it can be universally used. The retention force of the jaws is simple to adjust by varying the pressure for the cylinder-piston unit, and this also assures short actuation time. Finally, its structure is simple and easy to understand.

The invention will be better understood and further objects and advantages thereof will become more apparent from the ensuing detailed description of a preferred embodiment taken in conjunction with the drawings.

BRIEF DESCCRIPTION OF THE DRAWINGS

FIG. 1 is a fragmentary sectional side view of a screw head in the closed position; and FIG. 2 shows the screw head of FIG. 1, again in section, in the opened position.

DESCRIPTION OF THE EXEMPLARY EMBODIMENT

Figure 1:
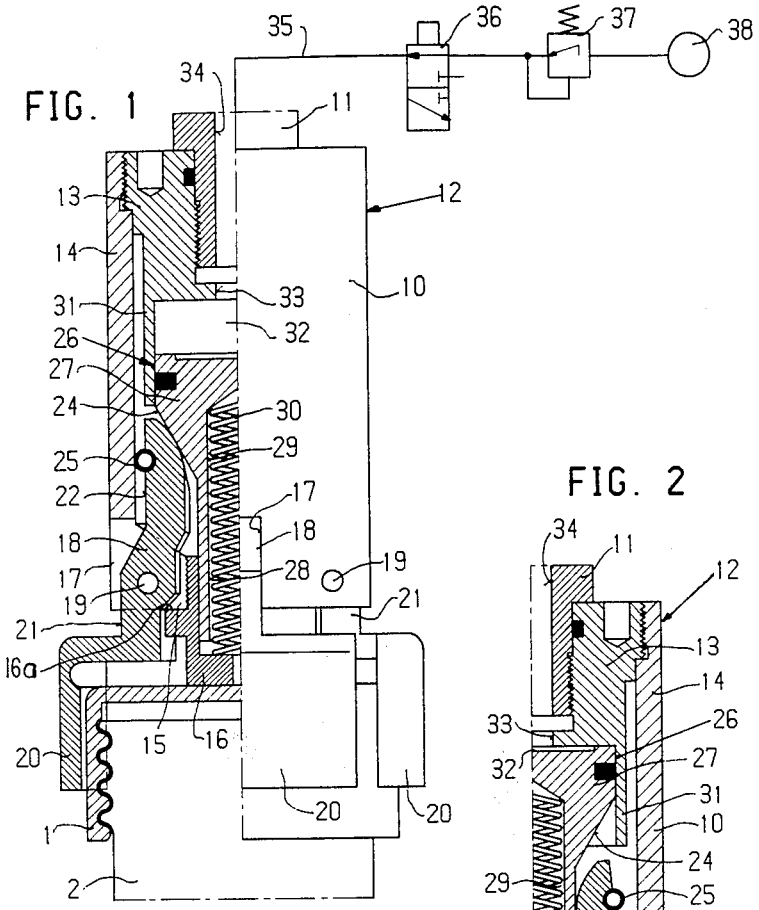

A screw head 10 is replaceably secured to the lower end of an incrementally rotatable spindle 11, which can also reciprocate up and down. It has a two-part holder 12, which comprises a cap part 13 screwed onto the spindle 11 and a radially positioned sleeve 14 screwed onto the cap part 13. At the lower end of the sleeve 14, there is a radially inwardly oriented collar 15, into which a bushing 16 is threaded up to a shoulder 16(*a*). Four equally displaced radial slits 17 are also disposed, crosswise, on the lower end of the sleeve 14 and in its collar 15. One lever 18 is pivotably supported on a pin 19 in each of the slits 17. The lower arm 21 of each lever protrudes downward out of the sleeve 14 and is adjoined by a retaining jaw 20. The four retaining jaws 20 form tongs for grasping and tightly holding a closure cap 1. The upwardly extending arm 22 of each lever 18 engages the interior of the sleeve 14 and rests with its radially inwardly oriented, crowned surface on an actuating cone 24. An annular spring 25 rests on an outer surface of each upwardly extending arm 22 and presses each of the upper arms 22 against the actuating cone 24.

The actuating cone 24 is connected to a cylinder-piston unit 26 actuated by a pressure medium. This cone is an integral part of the piston 27 of the cylinder-piston unit 26 and takes the form of the transition from the piston 27 to a downwardly protruding piston rod 28. The piston rod 28 has a blind bore 29, in which a helical spring 30 is disposed, which is supported on the upper surface of the bushing 16 and presses the piston 27 upward. The piston 27 is displaceably guided in an extension that protrudes downward from the cap part 13 and is embodied as a cylinder liner 31. A work chamber 32 of the cylinder-piston unit 26 surrounds the cylinder liner 31 and communicates with a source 38 of pressure medium, preferably compressed air, via a bore 33 in the cap part 13, a longitudinal bore 34 in the spindle 11, a line 35 and an electromagnetically actuated switch valve 36 as well as an adjustable pressure reduction valve 37. The retention force of the retaining jaws 20 can be varied in simple fashion by adjusting the pressure at the pressure reduction valve 37.

Figure 2:
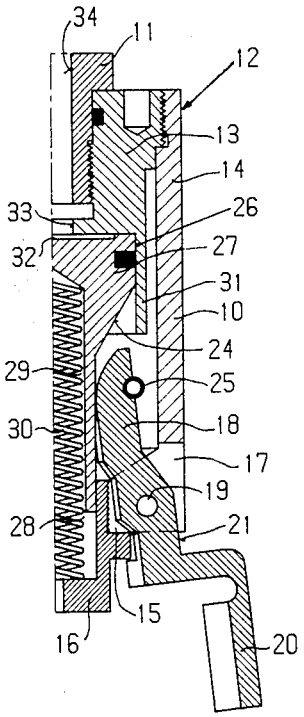

The above-described screw head functions as follows:

When the work chamber 32 of the cylinder-piston unit 26 is without pressure, the helical spring 30 presses the piston 27 upward, so that the upper arms 22 of the levers 18, under the influence of the annular spring 25, rests on the piston rod 28 (see FIG. 2). The retaining jaws 20 are pivoted outward by the levers 18 into an opened position. In this position, a screw cap 1 is pushed in between the retaining jaws 20 until it rests against the bushing 16. Compressed air from the compressed air source 38 is then let into the work chamber 32, by switching over the switch valve 36, so that the pressure buildup in the work chamber 32 displaces the piston 27 downward. In this process, the actuating cone 24 of piston 27 is pushed farther and farther between the upper arms 22 of the levers 18, pivoting the levers about pivot 19 and causing the retaining jaws 20 to come to rest on the circumference of the cap 1. Depending on the pressure in the work chamber 32, which is adjusted with the pressure reduction valve 37, the pressure exerted by the retaining jaws 20 on the screw cap 1 is adjustable from slight to firm. Once a container 2 that is to be closed is moved into alignment with the screw head 10 and the spindle 11 is lowered, the closure cap 1 that has been grasped is screwed onto the container 2 by rotation of the spindle and hence of the screw head 10. The tightening moment of the closure cap 1 is adjusted at the drive mechanism of the spindle 11. Since the spindle 11 and the screw head 10 have little inertia, uniform tightening of closure caps 1 onto containers is possible. Also, because of the small masses of the cylinder-piston unit and actuating cone, short opening and closing times of the retaining jaws are possible. Once the cap has been tightened the valve 36 is opened and the pressure is forced from the pressure chamber 32 thereby permitting the jaws 20 to open due to an upward movement of piston 27.

The foregoing relates to preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A screw head on a container-closing machine which comprises a holder (12) secured on a rotatable and reciprocating spindle (11), a pressure chamber (32) formed in said spindle (11), a piston (27) operative in said cylinder, said pressure chamber in said spindle bounded on one side by said piston, said piston having a conical section (24) and a cylindrical section forming a piston rod (28), a plurality of equally spaced levers (18) pivotally disposed within said holder, each of said levers include a jaw (20) integral therewith, means for moving one end (22) of each of said levers radially toward one another so that they rest upon said conical section of said piston which in a first position of rest, said jaws are spread apart for receiving a screw cap closure (1), means for applying a fluid pressure to said pressure chamber to axially move said piston and said conical section against said upper end of said lever to force said jaws to a second position which tightly holds said cap for screwing onto a container (2), whereby during a downward rotational movement of said spindle, said screw cap is threaded onto said container.

2. A screw head as defined by claim 1, in which said holder (12) comprises a cap part (13), secured on the spindle (11), and a sleeve (14), which surrounds the work chamber piston unit (26) and in which the levers (18) of the jaws (20) are supported.

3. A screw head as set forth in claim 2, in which said pivotable levers have an upper end and a lower end and said jaws (20) are integral with said lower end of said levers.

4. A screw head as set forth in claim 1, wherein said means for moving one end of each of said levers is a circular spring supported on an outer surface of each of said levers.

5. A screw head as set forth in claim 1, which includes a bushing (16) threaded into said holder, said bushing including a shoulder, spring means supported on one end by said bushing shoulder and on its other end by said piston which forces said piston to a position of rest when no pressure is applied to said work chamber.

6. A screw head as set forth in claim 2, which includes a bushing (16) threaded into said holder, said bushing including a shoulder, spring means supported on one end by said bushing shoulder and on its other end by said piston which forces said piston to a position of rest when no pressure is applied to said work chamber.

7. A screw head as set forth in claim 3, which includes a bushing (16) threaded into said holder, said bushing including a shoulder, spring means supported on one end by said bushing shoulder and on its other end by said piston which forces said piston to a position of rest when no pressure is applied to said work chamber.

8. A screw head as set forth in claim 4, which includes a bushing (16) threaded into said holder, said bushing including a shoulder, spring means supported on one end by said bushing shoulder and on its other end by said piston which forces said piston to a position of rest when no pressure is applied to said work chamber.

* * * * *